US008646117B2

(12) United States Patent
Avetisian

(10) Patent No.: US 8,646,117 B2
(45) Date of Patent: Feb. 11, 2014

(54) ANTI-SIPHON TRAP WITH SNORKEL

(75) Inventor: Robert Avetisian, Pico Riviera, CA (US)

(73) Assignee: Falcon Waterfree Technologies, LLC, Los Angeles, CA (US)

( * ) Notice: Subject to any disclaimer, the term of this patent is extended or adjusted under 35 U.S.C. 154(b) by 602 days.

(21) Appl. No.: 12/661,027

(22) Filed: Mar. 9, 2010

(65) Prior Publication Data

US 2010/0230333 A1 Sep. 16, 2010

Related U.S. Application Data

(60) Provisional application No. 61/210,115, filed on Mar. 12, 2009.

(51) Int. Cl.
*E03C 1/28* (2006.01)
*E03C 1/29* (2006.01)

(52) U.S. Cl.
USPC ..... 4/144.1; 4/301; 137/247.11; 137/247.29

(58) Field of Classification Search
USPC ..... 4/144.1, 301; 137/247.11, 247.29
See application file for complete search history.

(56) References Cited

U.S. PATENT DOCUMENTS 637,285 A * 11/1899 Riedel et al. ..... 210/455
817,469 A 4/1906 Cleland
6,425,411 B1 * 7/2002 Gorges ..... 137/247.39
6,644,339 B2 * 11/2003 Gorges et al. ..... 137/315.41
7,571,741 B2 * 8/2009 Higgins ..... 137/247.29
7,575,022 B2 * 8/2009 Higgins ..... 137/558
2005/0229297 A1 * 10/2005 Higgins ..... 4/301
2008/0028504 A1 * 2/2008 Higgins et al. ..... 4/144.1

FOREIGN PATENT DOCUMENTS

| | | |
|---|---|---|
| AT | 1 821 | 7/1900 |
| DE | 464598 | 8/1928 |
| WO | WO2005/071173 | 8/2005 |
| WO | WO2007/149379 | 12/2007 |

* cited by examiner

*Primary Examiner* — Terry Cecil
(74) *Attorney, Agent, or Firm* — Lewis B. Sternfels

(57) ABSTRACT

To reduce the barrier sealant amount, the area of a throat (88), communicating an inlet compartment (78) to an outlet opening (64), is made small. Should sealant not be in the throat, wastewater in the throat would be correspondingly small. A snorkel (110) in a discharge section drain tube (98) extends downwards to above the level of the horizontal drain, and allows any air from the external drain to pass to the outlet compartment generally below the ceiling (90) so that, should wastewater cover the opening of the drain tube, such air is permitted to enter into the cartridge and to prevent any syphoning. A three rib channel guide mechanism (100) within the tube guides wastewater flow towards the drain tube center, and away from the drain tube walls to avoid deposit of any sediment contained in the wastewater.

21 Claims, 22 Drawing Sheets

FIG. 11
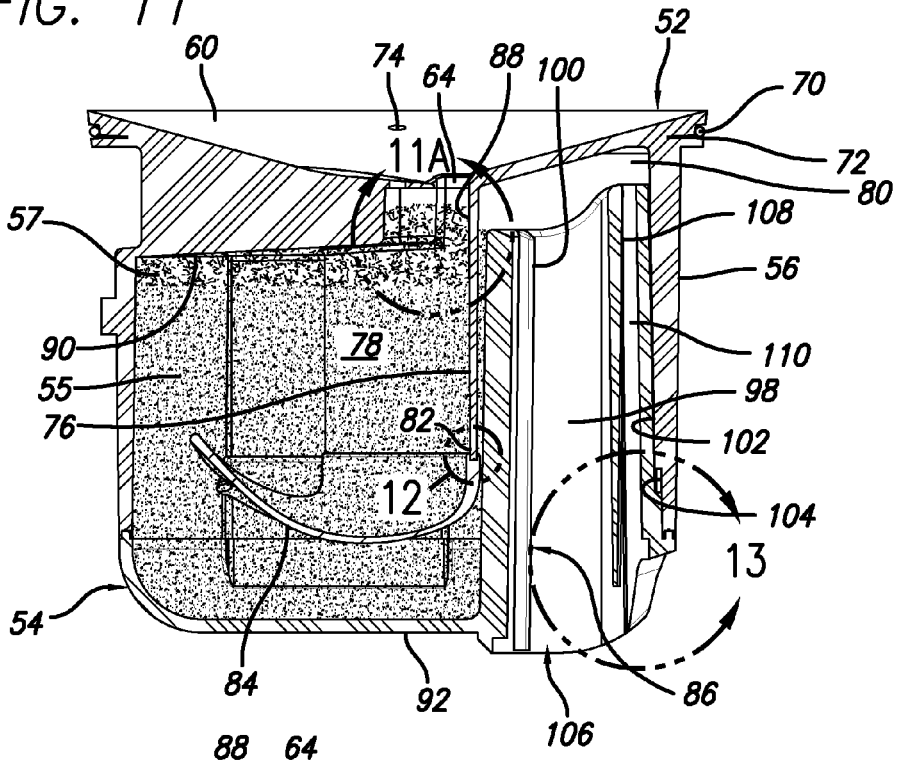
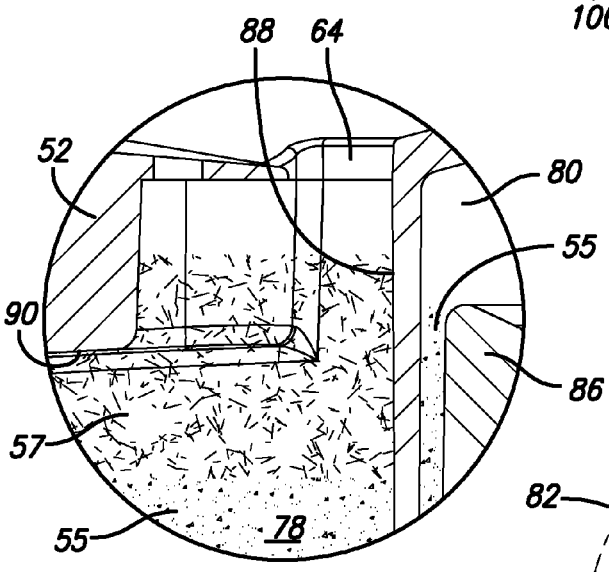
FIG. 11A
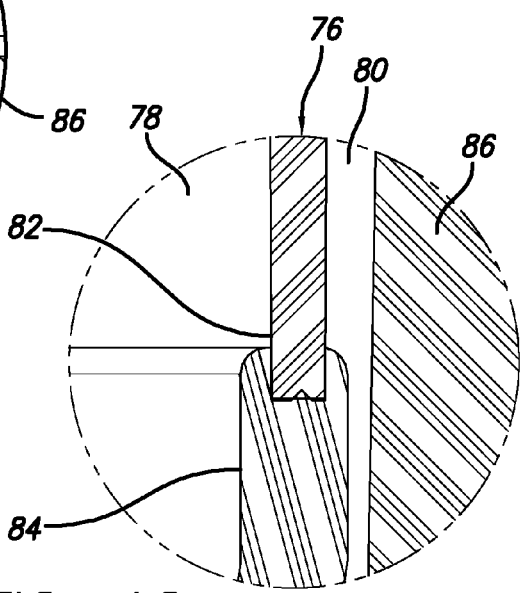
FIG. 12

ANTI-SIPHON TRAP WITH SNORKEL

CROSS-REFERENCE TO RELATED APPLICATION

This application claims the benefit of U.S. Provisional Application No. 61/210,115 filed 12 Mar. 2009. The following are related applications: U.S. application Ser. No. 11/812,242, filed 15 Jun. 2007, now abandoned, entitled "Urinal Cartridge with Increased Sediment Collection" and No. 60/878,635, filed 3 Jan. 2007, entitled "Urinal Cartridge with Improved Performance and U.S. application Ser. No. 11/032,310 (now U.S. Pat. No. 7,571,741 dated 11 Aug. 2009) and Ser. No. 11/032,508 (now U.S. Pat. No. 7,575,022 dated 18 Aug. 2009), both filed 9 Jan. 2005.

REFERENCE REGARDING FEDERAL SPONSORSHIP

Not Applicable

REFERENCE TO MICROFICHE APPENDIX

Not Applicable

1. Field of the Invention

The present invention relates to a flow trap, such as a cartridge used in water-free urinals having an odor-preventing oily sealant closure mechanism and, in particular, to improving flow trap life and usability, including a reduction in the amount or volume of the odor-preventing oily sealant needed for its purpose of acting as a barrier to drain odors.

2. Description of Related Art and Other Considerations

Syphoning is a significant problem with waterfree traps. Janitors typically clean individual traps by dumping a bucket of water over the trap, thereby flushing out the malodorous waste water. Unfortunately, such dumping can overwhelm the ability of the drain stand or drain tube to receive the excess water, such as by completely filling the discharge or outlet compartment to its ceiling, thus creating a syphon effect, which thereby sucks the wastewater and sealant from the entry compartment. This problem can be created also by other events, such as through a sudden and heavy use. Regardless of the form of the event, the sealant is lost and, with it, its odor fighting capability. Furthermore, when sealant is lost through such events, the remaining sealant must be sufficient in quantity to act as an odor barrier; however, when the surface area of the wastewater and the sealant floating thereon in the inlet compartment is largely exposed under the cartridge opening, such remaining sealant may, over a period of time, become insufficient to serve its purpose and, therefore, decrease the useful life of the cartridge, thus leading to increased cost of cartridge replacement or possible replenishment of sealant. Alternatively, a cartridge must incorporate an unnecessarily larger quantity of sealant.

SUMMARY OF THE INVENTION

These and other problems are successfully addressed and overcome by the present invention. The ceiling of the entry compartment is lowered and a throat or other small entry is positioned between the cartridge opening and the entry compartment ceiling, so as to reduce the area of sealant needed to act as an odor barrier to that of the throat as compared to the larger exposed area of prior cartridges. Further, a snorkel is incorporated in the drain stand or tube. Additionally, ribs in the drain stand improves flow or channeling of the wastewater or urine.

By lowering the ceiling over the entry compartment, in effect to position it slightly lower then the overflow level of the drain stand in the discharge compartment, there is the likelihood of having little or no air over the sealant except for the small area under the entry opening. This reduces odor because there is a smaller exposed liquid area.

The area of the drain stand is increased to reduce clogging. A greater surface or overflow area is present towards the center of the trap, from whence wastewater comes, which reduces the height that wastewater can reach before it tumbles over the edge; this also reduces the chance of wastewater covering the entire surface of the drain stand.

The entry into the trap is enlarged without being segmented and, therefore, is less prone to catching hair.

The overflow end of drain stand angled upwards away from center, as contrasted to the prior unit which had a horizontal surface. Angling avoids syphoning which can occur when the top of the drain stand is completely covered by liquid, such as in a bucket dump. The waste water is forced to reach a height well above the overflow level to completely or, at least better fill the opening up with water and reduce or eliminate any air pocket.

The channel guides, preferably, three in number, are positioned on the interior of the drain stand, on the side near the center of the trap, with the middle guide shorter than the other (not reaching the bottom). Traps are typically used with a horizontal drain, which is just below the bottom of the trap. Guiding the flow of wastewater towards the center, away from the wall of the drain stand near the center of the trap, keeps the wastewater flowing to the center of the drain and not depositing sediment on the bottom of the housing, which builds up and blocks the unit. Further accomplished by the middle guide not reaching the bottom, which moves the two streams together towards the center.

The wall separating the drain stand from the snorkel extends downwards to just below the outer wall of the snorkel.

Syphoning is avoided by creating a "window" over the water-flow to contact-air-flow that is present in drain line from pipe air trap.

The snorkel allows air from the drain to pass to the upper portion of the discharge compartment, just below the roof, so that, even if wastewater covers the opening of the drain stand, air can still enter and prevent syphoning.

Enlargement of the drain channel reduces or eliminates clogs in the drain tube.

Other aims and advantages, as well as a more complete understanding of the present invention, will appear from the following explanation of exemplary embodiments and the accompanying drawings thereof.

BRIEF DESCRIPTION OF THE DRAWINGS

FIG. 11 is a cross-sectional view of the cartridge shown in FIG. 4, taken along line 11-11 thereof;

FIG. 11A is a detail of the cartridge taken along cutaway line 11A of FIG. 11;

FIG. 12 is a detail of the cartridge taken along cutaway line 12 of FIG. 11;

DETAILED DESCRIPTION

Figure 1:
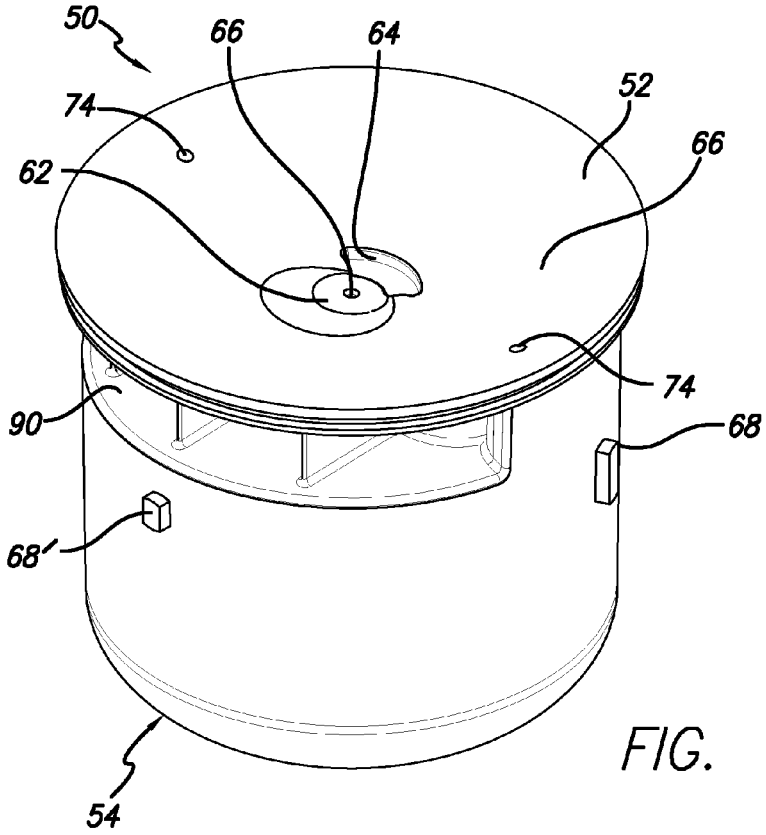
FIG. 1 is a perspective view of a urinal cartridge as embodied in the present invention, as viewed downwardly towards its top.
Figure 2:
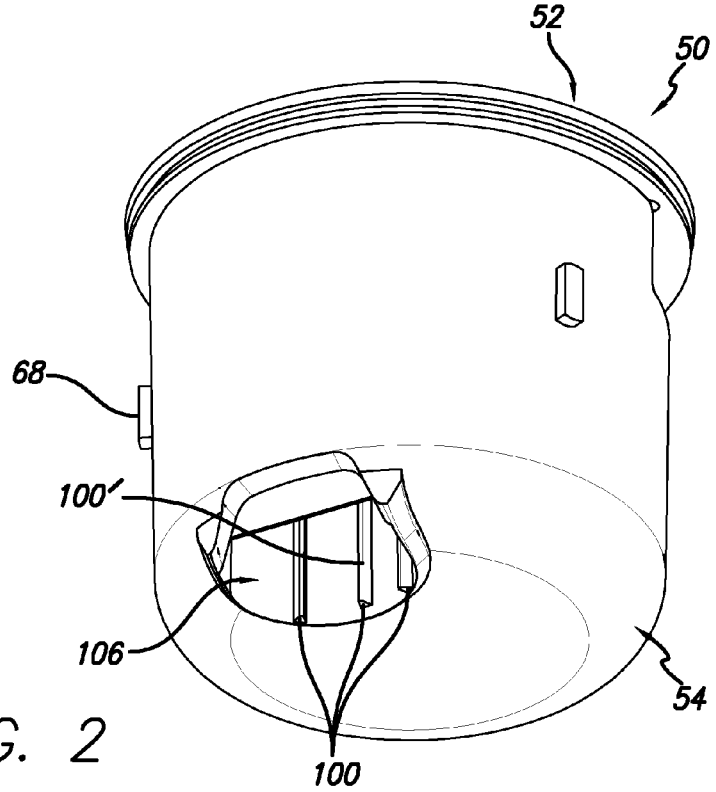
FIG. 2 is a perspective view of the urinal cartridge as depicted in FIG. 1, as viewed upwardly towards its bottom.
Figure 3:
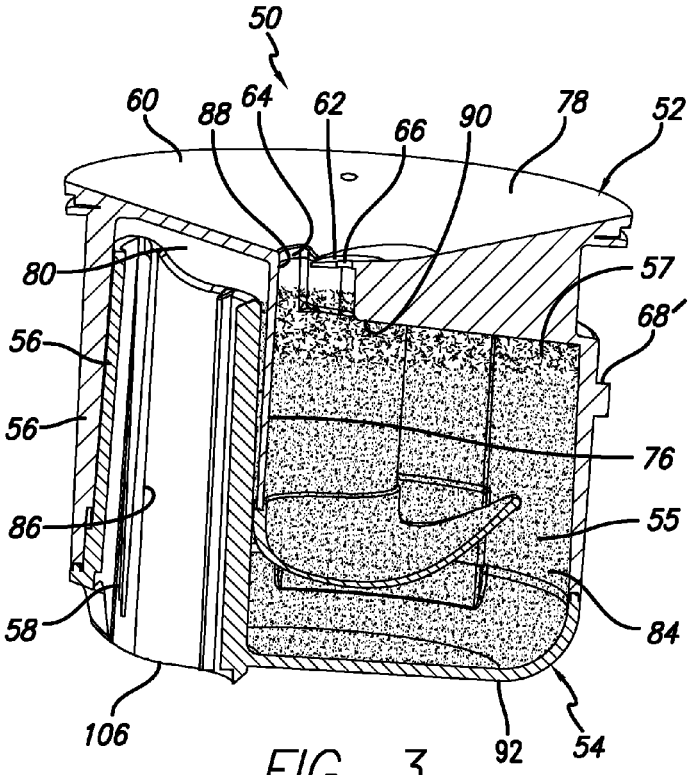
FIG. 3 is a perspective view of the urinal cartridge in cutaway cross-section, as depicted in FIGS. 1 and 2.
Figure 4:
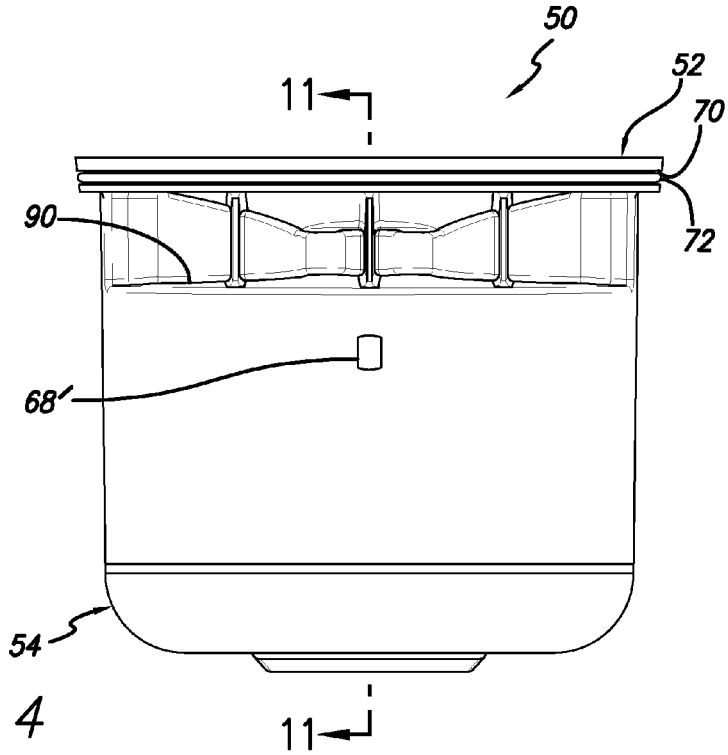
FIG. 4 is a side view of the urinal cartridge as shown in FIGS. 1 and 2
Figure 3A:
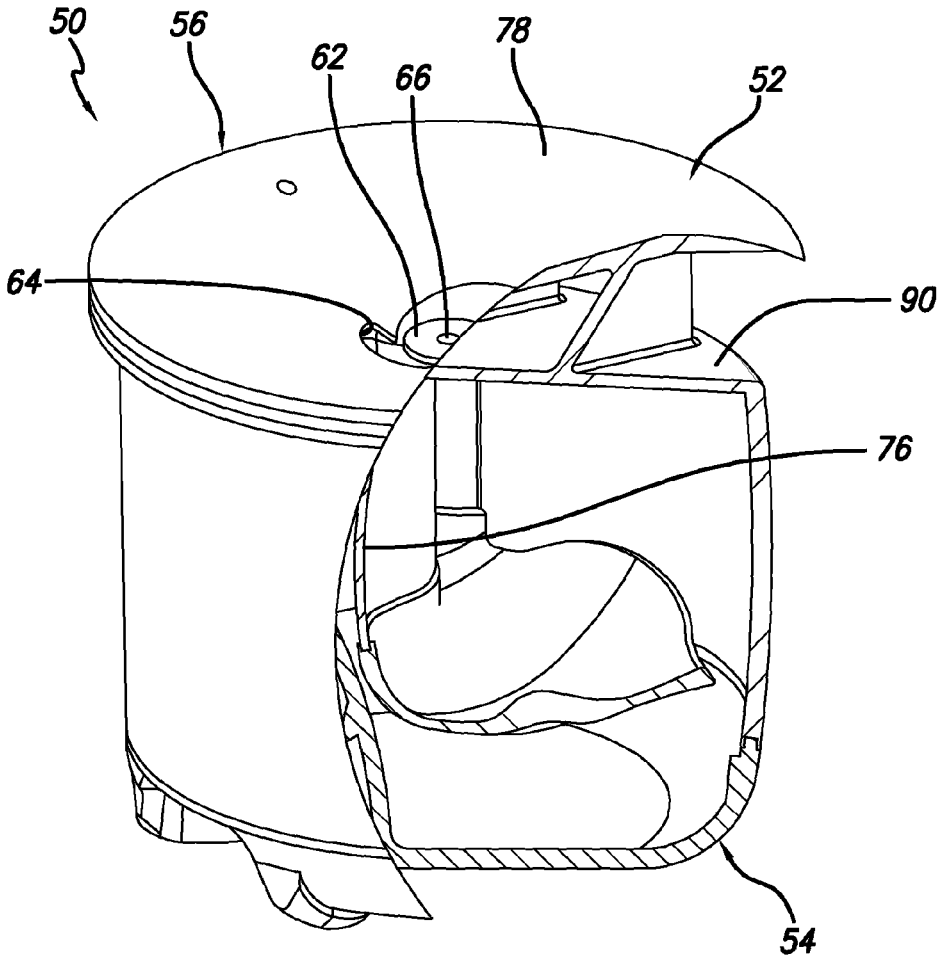
FIG. 3A is a perspective view of the urinal cartridge, angled differently from that as illustrated in FIG. 3, in cutaway cross-section as depicted in FIGS. 1 and 2.

Accordingly, as illustrated in FIGS. 1-18, a cartridge 50, such as capable of being inserted into a urinal housing, includes a top or top portion 52 and bottom or bottom portion 54. Such a cartridge is sometimes referred to as an "oil sealant-preserving drain odor trap." Cartridge 50 is capable of acting as a flow trap for urine or other generally fluid waste products. As shown in FIGS. 3, 11 and 11A, wastewater 55, such as a fluid with urine therein, and an oily liquid odor sealant 57 floating on the wastewater is contained within the cartridge, as described in above-cited application Ser. No. 11/812,242, No. 60/878,635, Ser. No. 11/032,310 and Ser. No. 11/032,508.

With reference also to FIGS. 19-28, top portion 52 has a cylindrical configuration defined by a tubular wall 56 terminated by an opening 58 at its lower end and a top wall 60 at its upper end. The top wall is sloped downwardly from its outer edge to a flat, generally horizontal flat center portion 62 in which an entry opening 64 is disposed (see, for example, FIGS. 1, 3, 3A, 8, 17, 18, 22 and 23) to act as a urine inlet. A hole 66 is centrally positioned within center portion 62. Top portion 60 is further provided with three keys 68, of which one 68' may be of different length than the other two (e.g., see FIGS. 1-6), for purposes of properly placing and orienting cartridge 50 within a urinal, as more fully described in U.S. Pat. No. 6,644,339.

Figure 5:
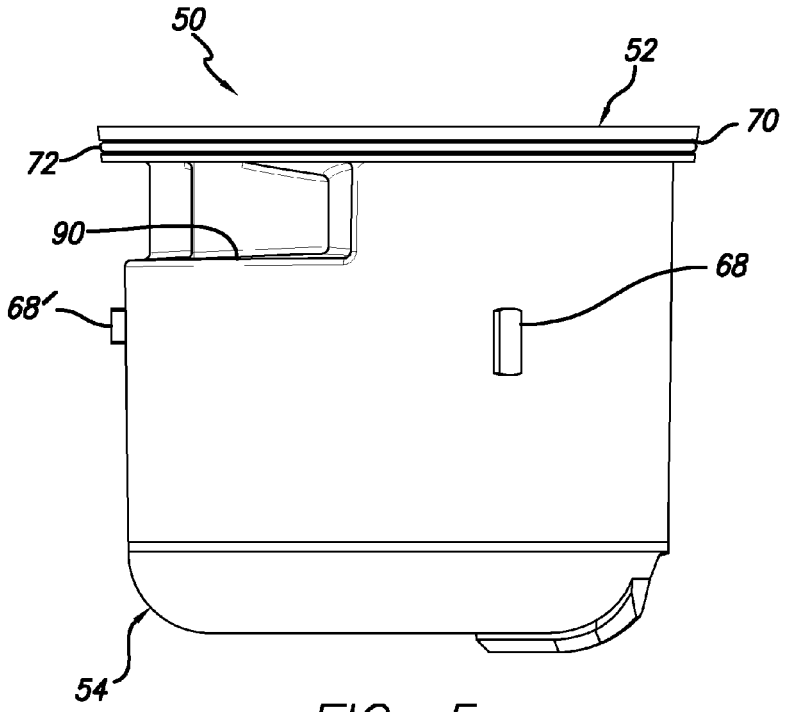
FIG. 5 is a side view of the urinal cartridge taken 90° from that as illustrated in FIG. 4.
Figure 6:
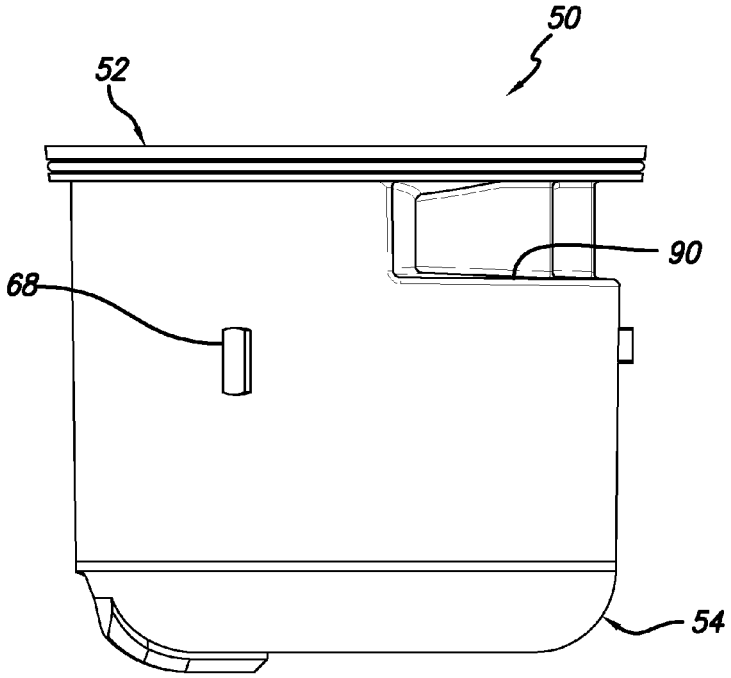
FIG. 6 is a side view of the urinal cartridge taken 180° from that as illustrated in FIG. 5.
Figure 7:
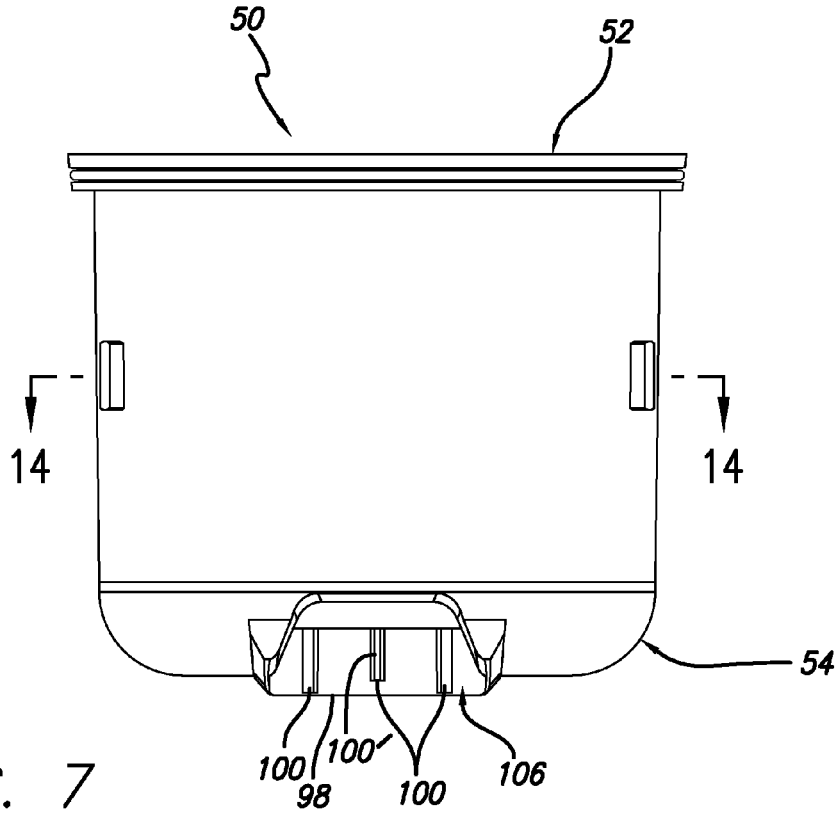
FIG. 7 is a side view of the urinal cartridge taken 180° from that as illustrated in FIG. 4.
Figure 8:
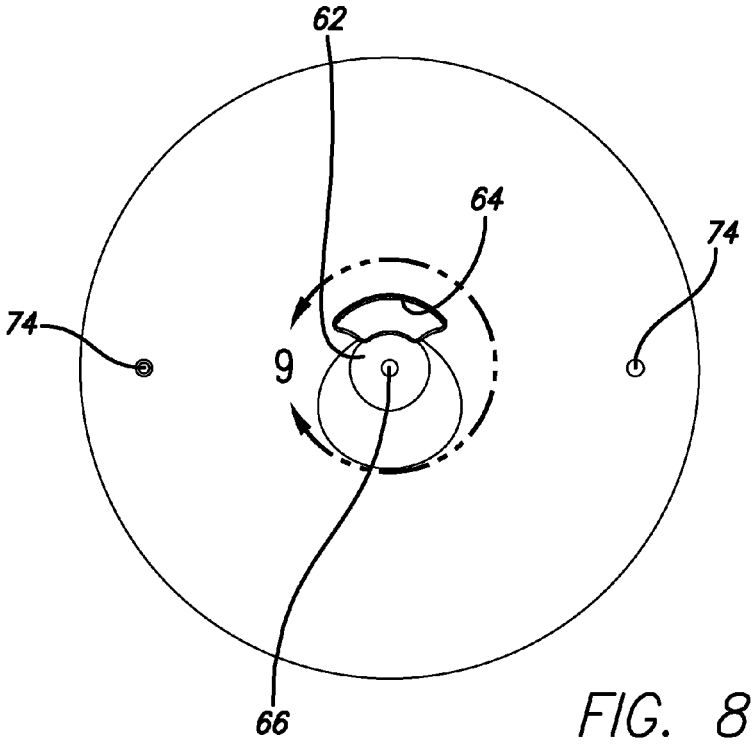
FIG. 8 is a top view of the cartridge depicted in FIG. 4.
Figure 9:
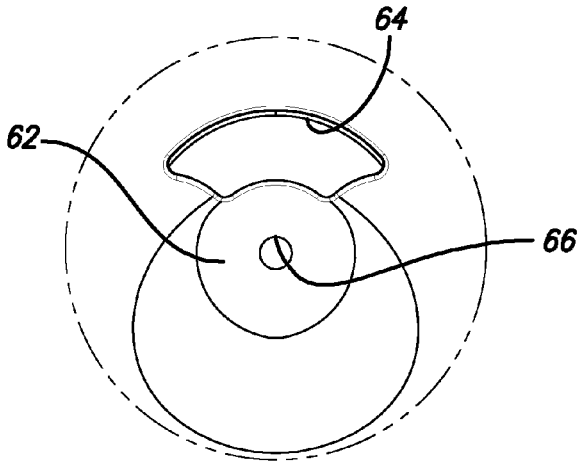
FIG. 9 is a detail of the cartridge taken along cutaway line 9 of FIG. 8.
Figure 10:
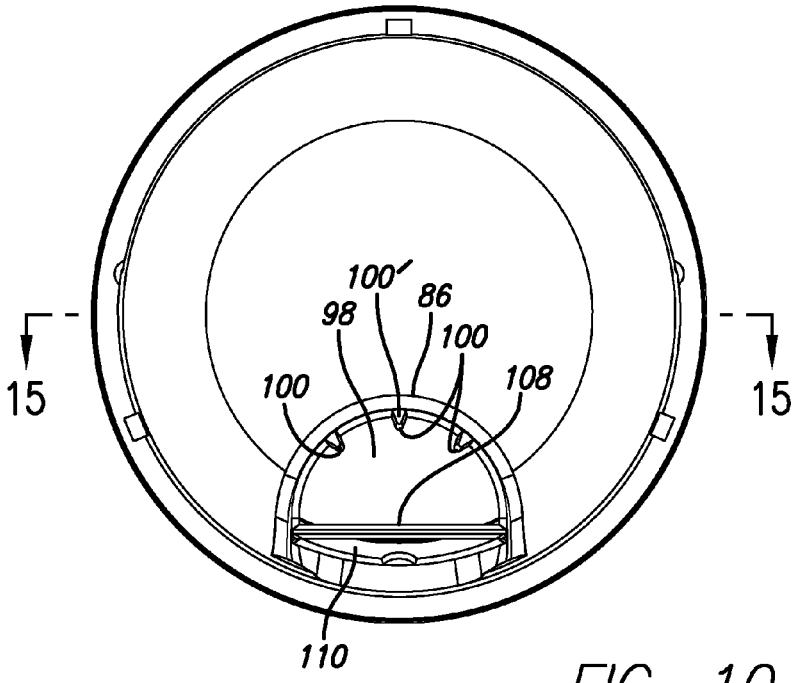
FIG. 10 is a bottom view of the cartridge depicted in FIG. 4.
Figure 13:
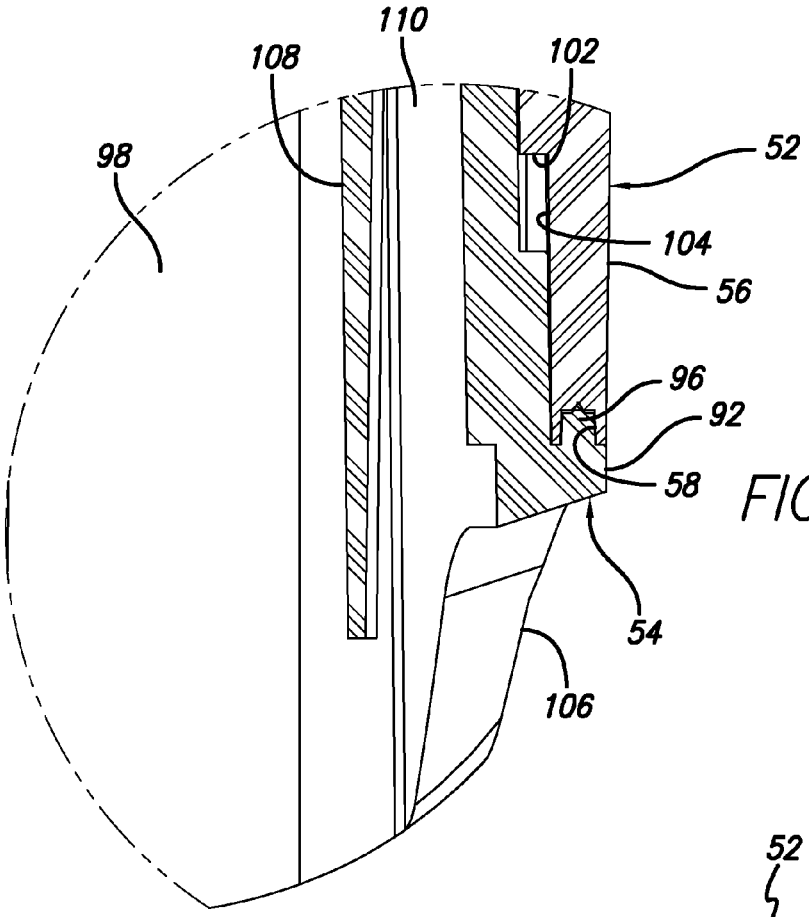
FIG. 13 is a detail of the cartridge taken along cutaway line 13 of FIG. 11.
Figure 14:
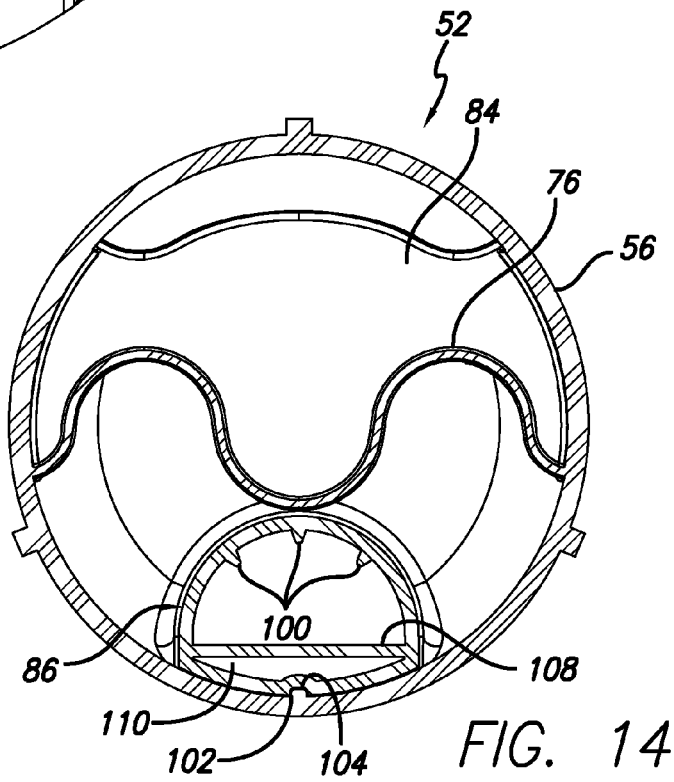
FIG. 14 is a cross-sectional view of the cartridge illustrated in FIG. 7, taken along line 14-14 thereof.
Figure 15:
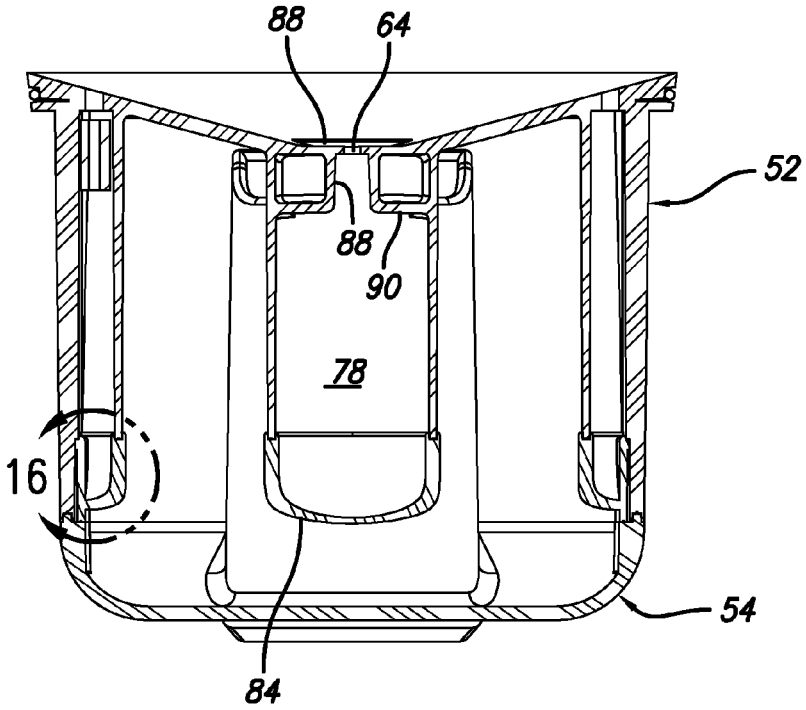
FIG. 15 is a cross-sectional view of the cartridge illustrated in FIG. 10, taken along line 15-15 thereof.
Figure 16:
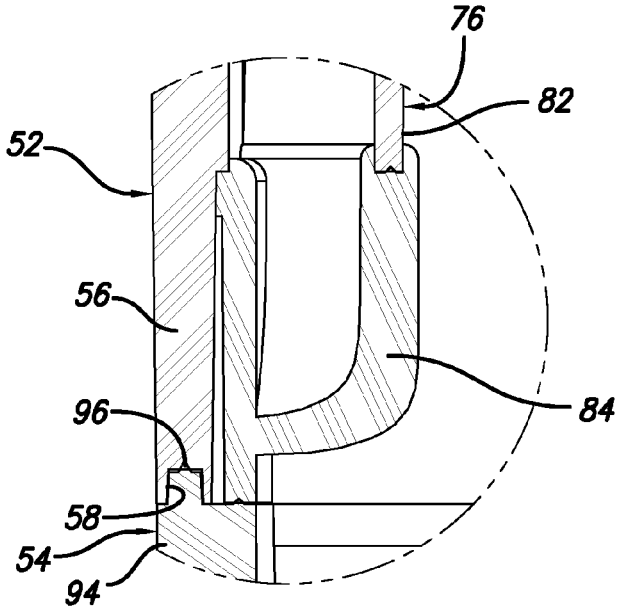
FIG. 16 is a detail of the cartridge taken along cutaway line 16 of FIG. 15.
Figure 17:
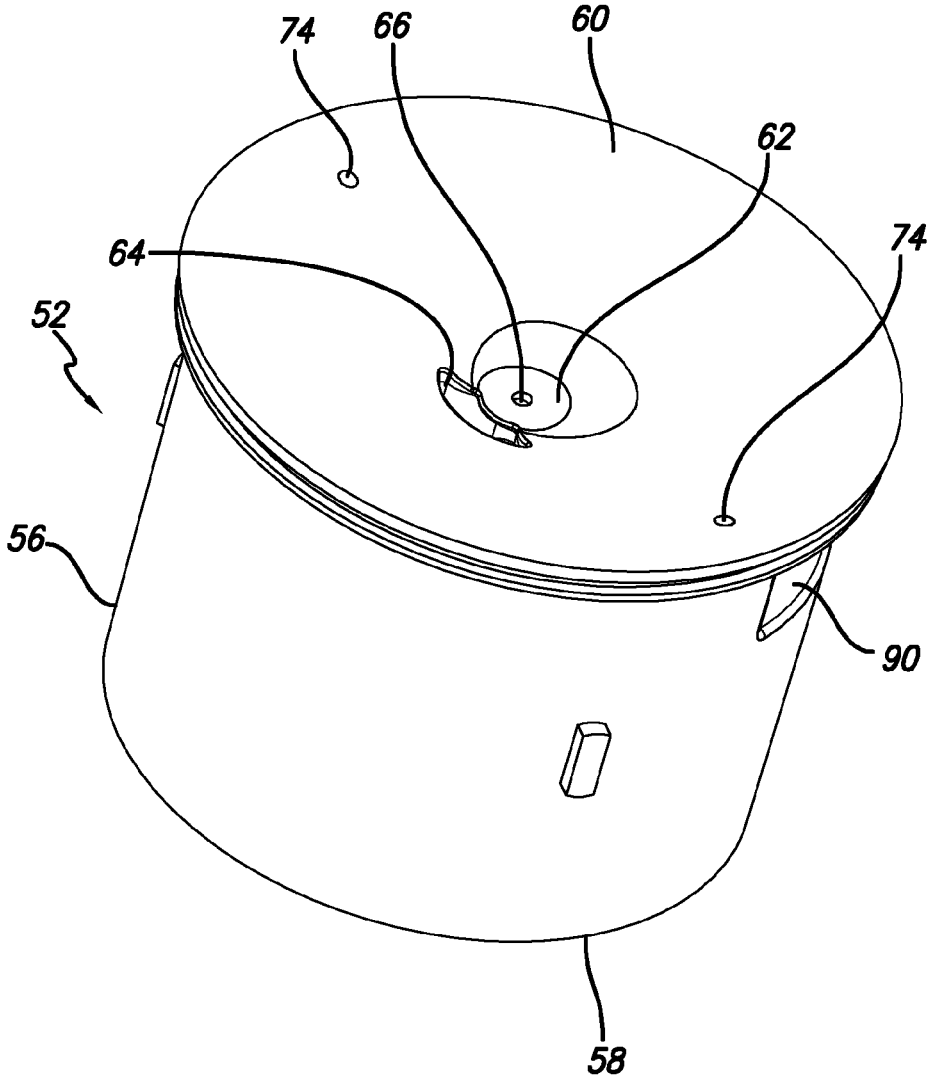
FIG. 17 is a perspective view of the top of the urinal cartridge as previously depicted, as viewed downwardly towards its top.
Figure 18:
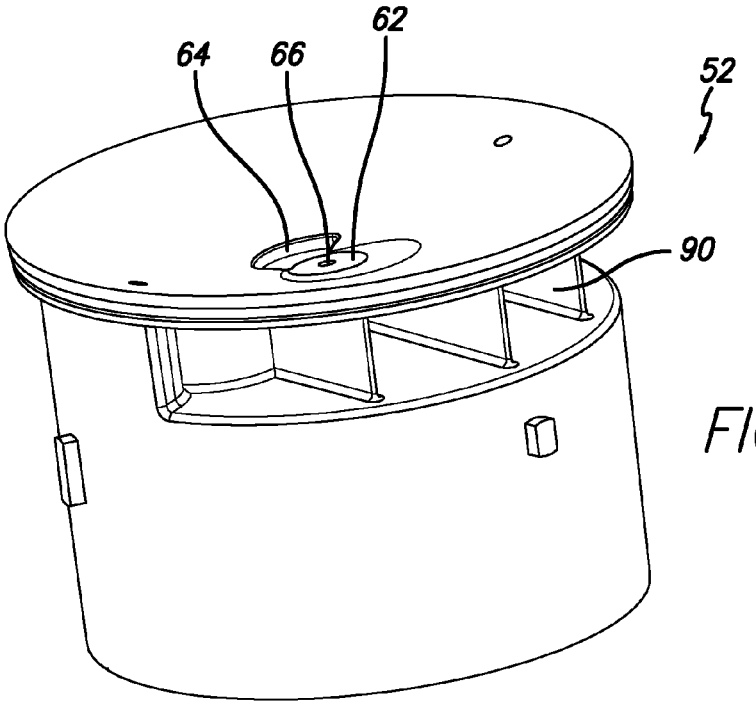
FIG. 18 is a perspective view of the top of the urinal cartridge as previously depicted, as viewed downwardly towards its top, similarly as shown in FIG. 17, but turned 90° therefrom.

Top wall 60 is provided with a recess 70, for example as shown in FIGS. 5 and 11, at its outer periphery to accept a seal, such as O-ring seal 72.

Top wall 60 of top portion 52 is further provided with openings 74 (e.g., see FIGS. 1, 8, 11, 17 and 23), which act as air vents that communicate with the interior of cartridge 50. In the event that one opening becomes clogged, such as by evaporated urine residue when the urinal is in use, there will be at least one that remains open. Openings 74 also provide a means by which a tool may be inserted therein for the purpose of inserting and removing the cartridge into and from a urinal, as also described in U.S. Pat. No. 5,711,037 and U.S. Pat. No. 6,425,411 and U.S. publication No. 2005/0229297.

Figure 19:
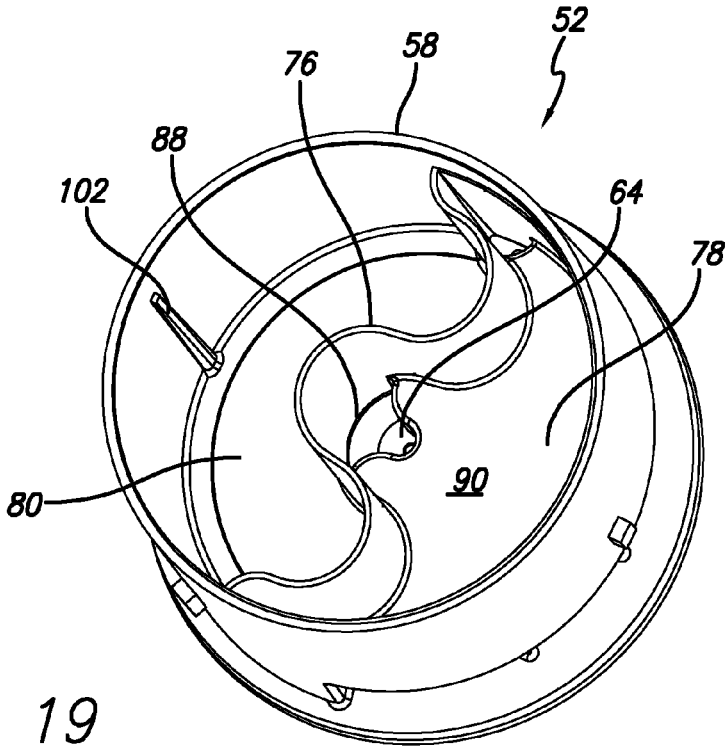
FIG. 19 is a perspective view of the top of the urinal cartridge as previously depicted, as viewed upwardly at its under side.
Figure 20:
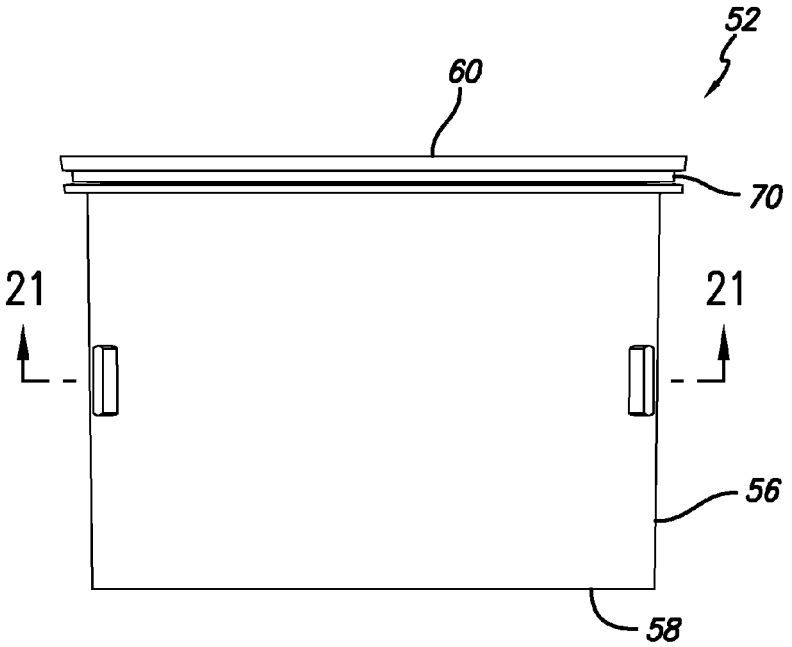
FIG. 20 is a side view of the cartridge top.
Figure 21:
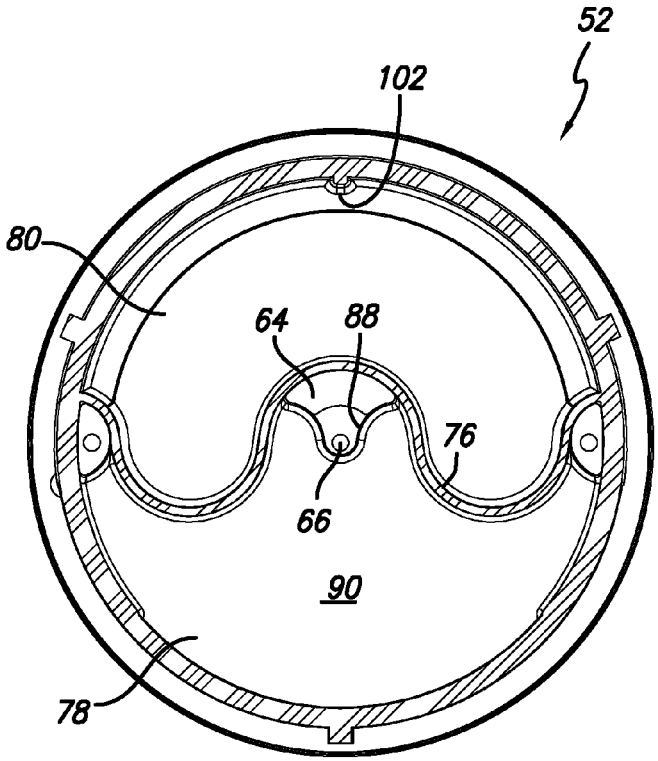
FIG. 21 is a cross-sectional view of the cartridge top taken along line 21-21 of FIG. 20.
Figure 22:
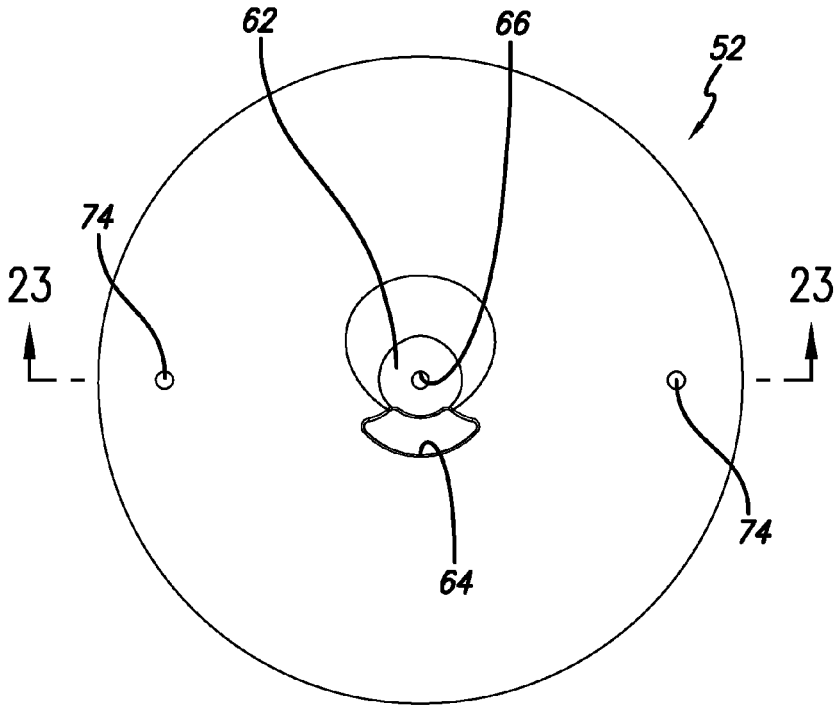
FIG. 22 is a top view of the cartridge top.
Figure 23:
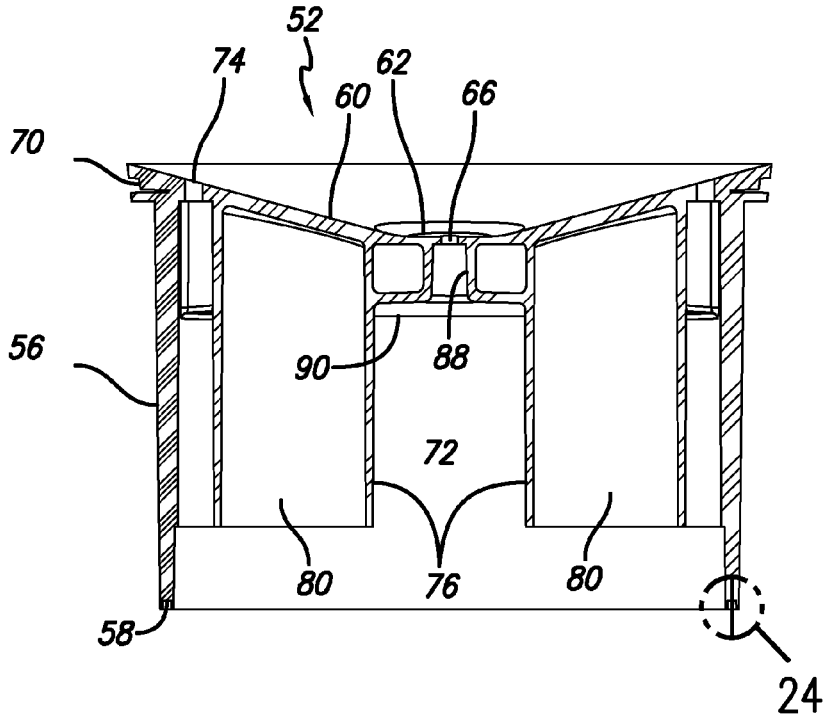
FIG. 23 is a cross-sectional view of the cartridge top taken along line 23-23 of FIG. 22.
Figure 25:
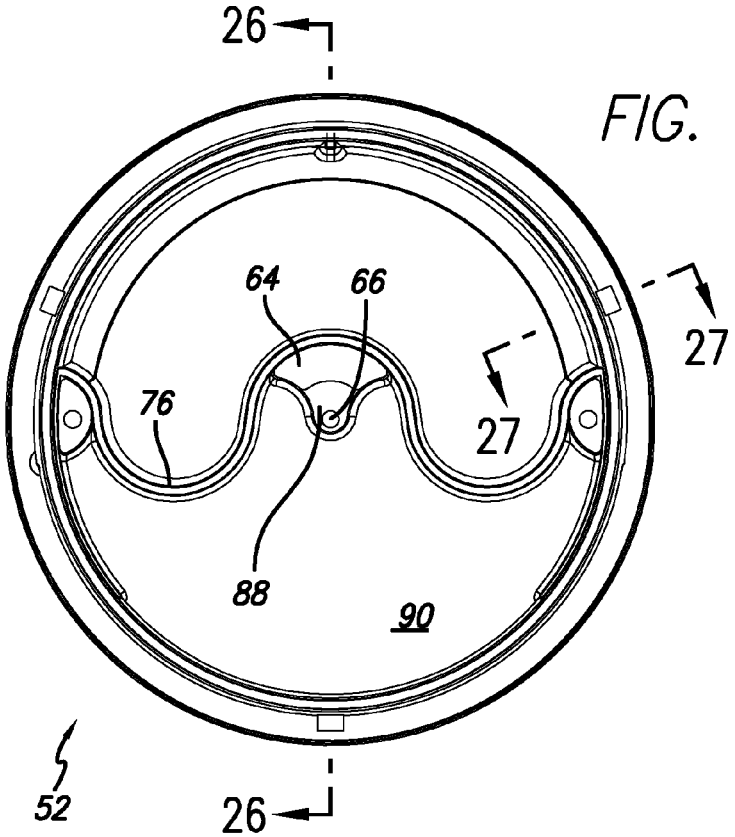
FIG. 25 is a bottom view of the cartridge top similar to that shown in FIG. 21 but not in cross-section.
Figure 26:
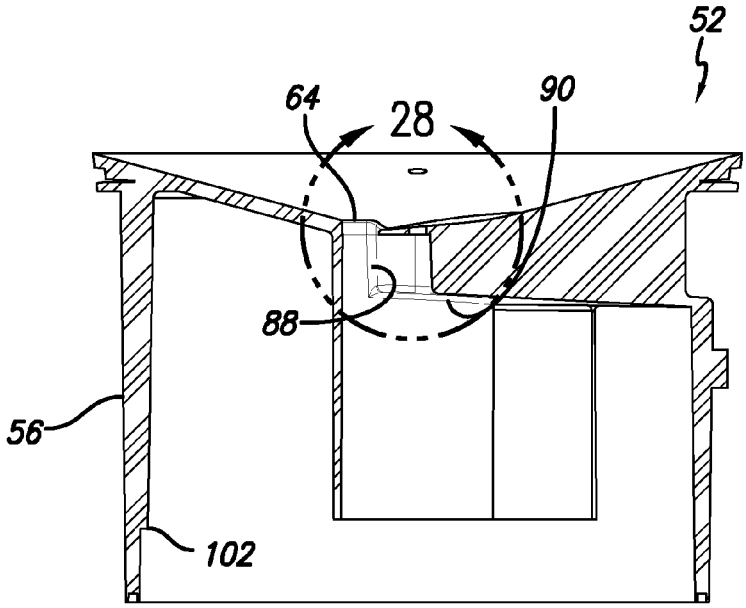
FIG. 26 is a cross-sectional view of the cartridge top taken along line 26-26 of FIG. 25.
Figure 24:
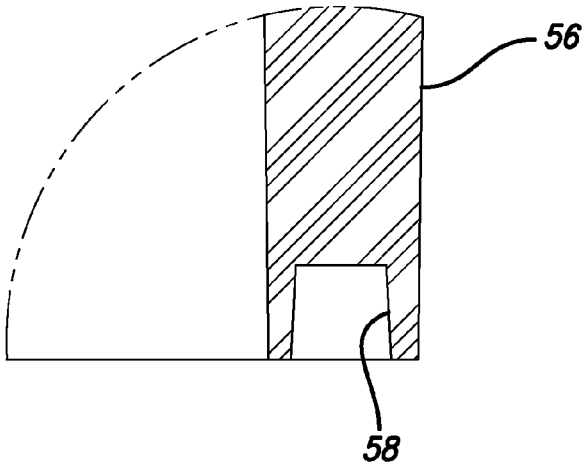
FIG. 24 is a detail of the cartridge taken along cutaway line 24 of FIG. 23.
Figure 27:
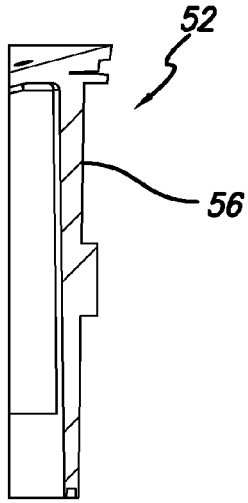
FIG. 27 is a cross-sectional view of the cartridge top taken along line 27-27 of FIG. 25.
Figure 28:
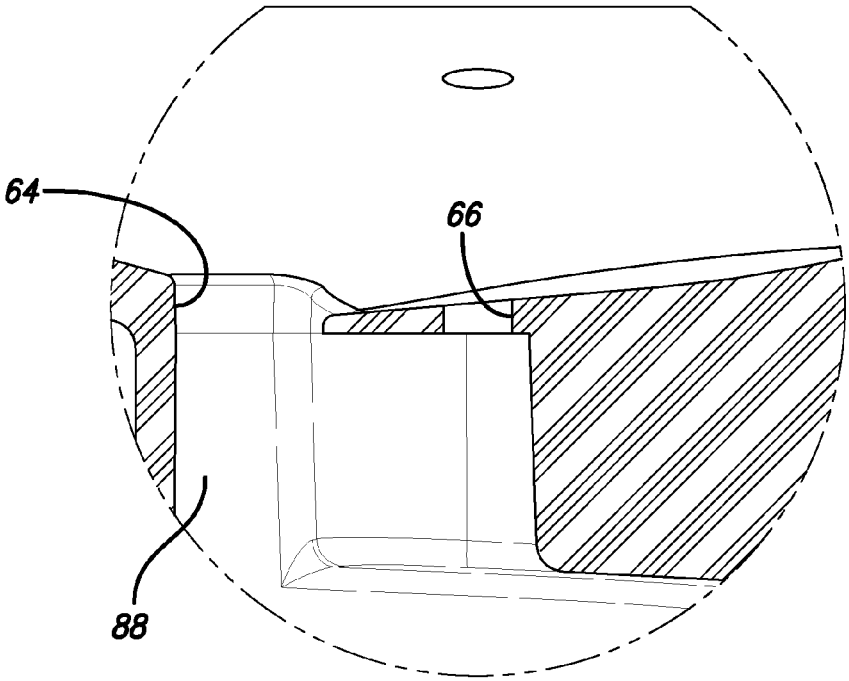
FIG. 28 is a detail of the cartridge top taken along cutaway line 28 of FIG. 26.
Figure 29:
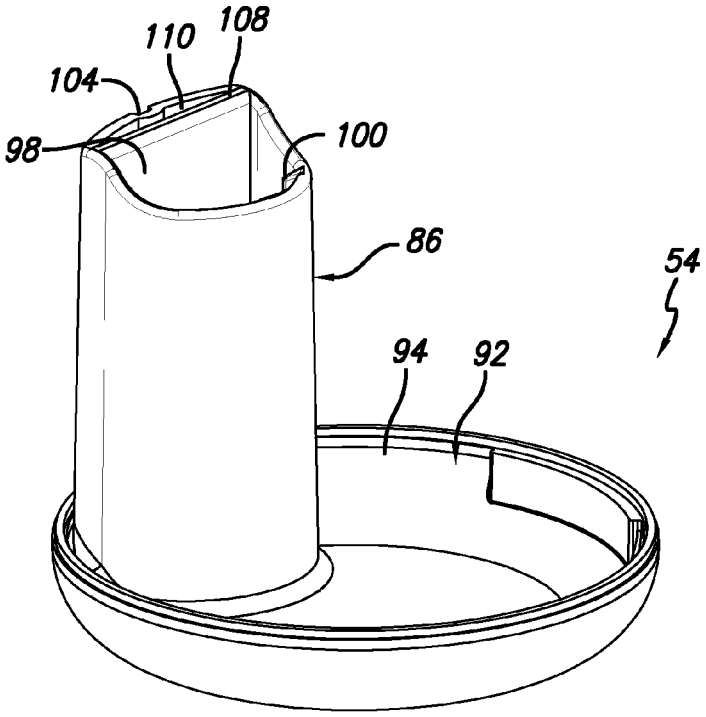
FIG. 29 is a perspective view of the bottom of the urinal cartridge as previously depicted, as viewed downwardly towards its top.
Figure 30:
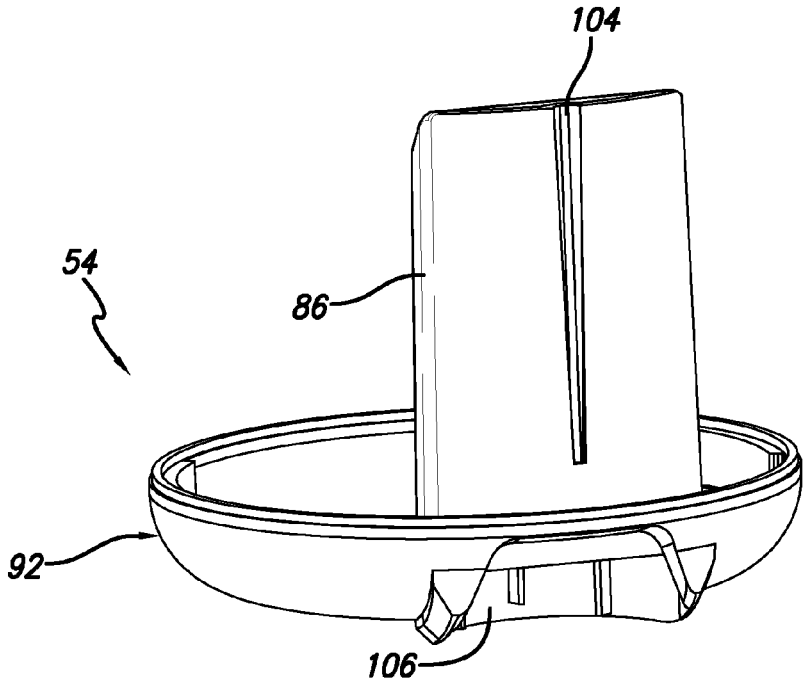
FIG. 30 is a perspective view of the urinal cartridge bottom as depicted in FIG. 29 but turned at an angle therefrom, as viewed somewhat downwardly towards its top.
Figure 31:
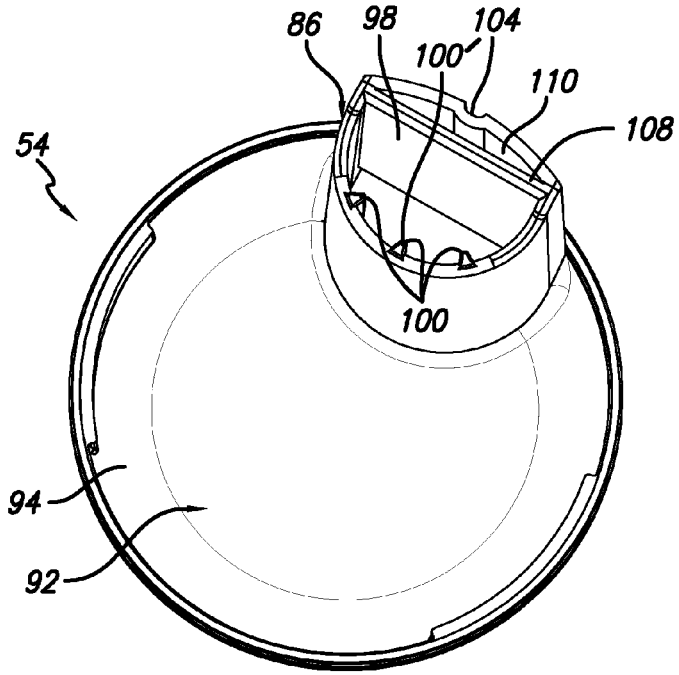
FIG. 31 is a perspective view of the urinal cartridge bottom as depicted in FIG. 29 but turned at an angle therefrom, as viewed essentially downwardly towards its top.
Figure 32:
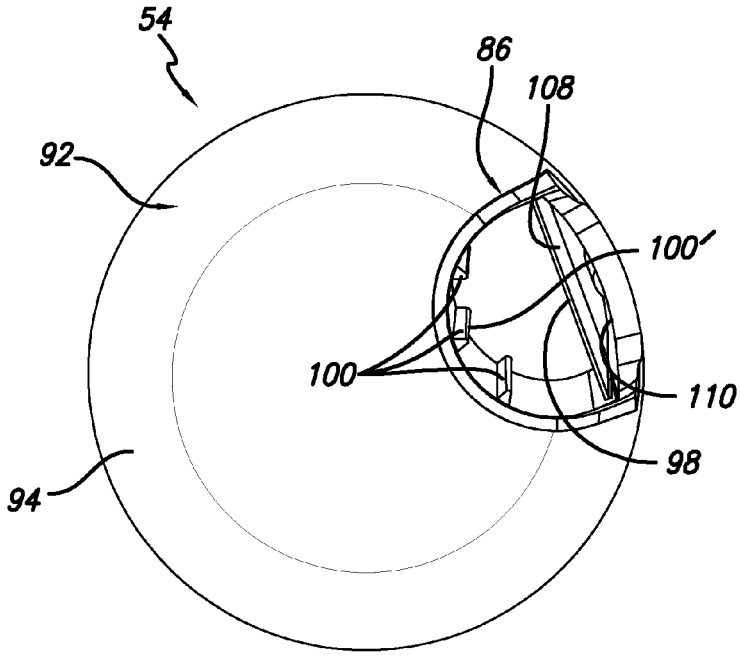
FIG. 32 is a perspective view of the urinal cartridge bottom as depicted in FIG. 29, as viewed upwardly towards its bottom.
Figure 33:
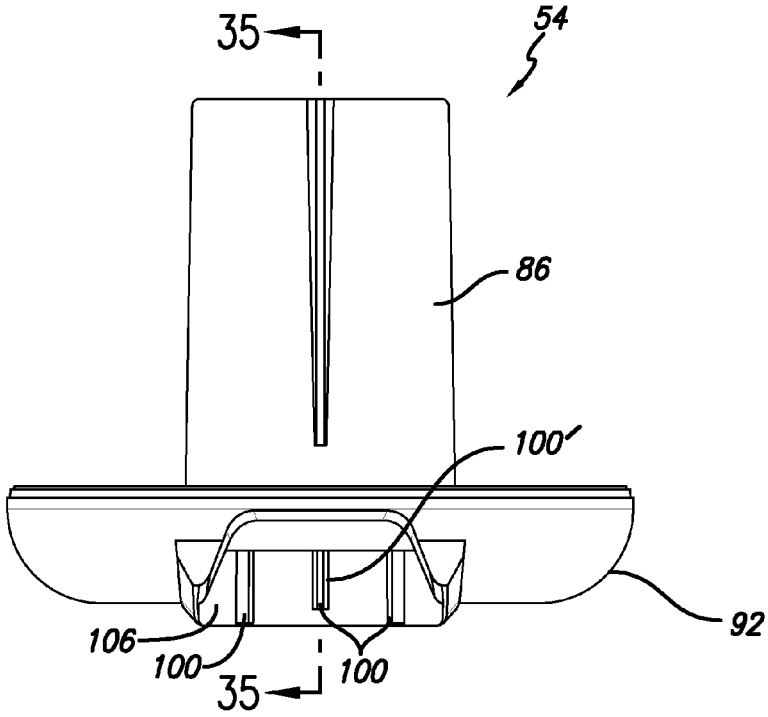
FIG. 33 is a side view of the cartridge bottom, as similarly viewed as in FIG. 30 and slightly rotated from the view depicted therein.
Figure 34:
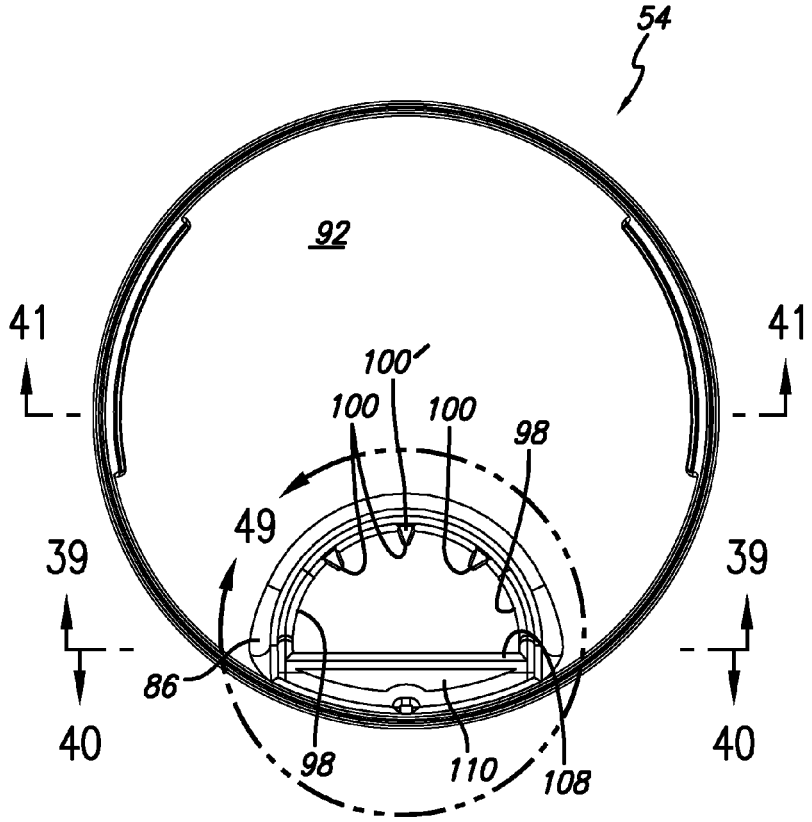
FIG. 34 is a top view of the cartridge bottom.
Figure 35:
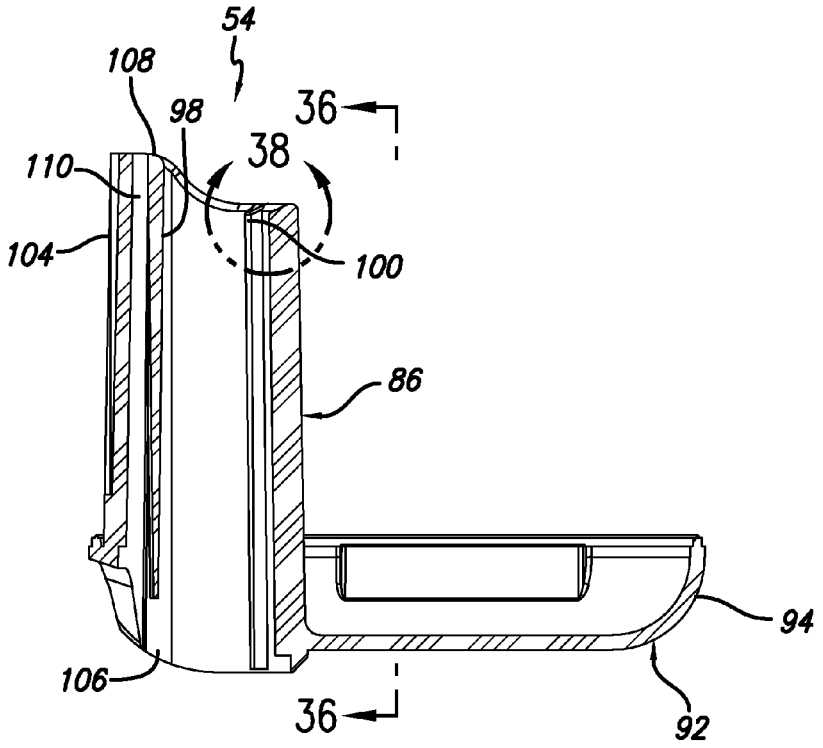
FIG. 35 is a cross-sectional view of the cartridge bottom taken along line 35-35 of FIG. 33.
Figure 36:
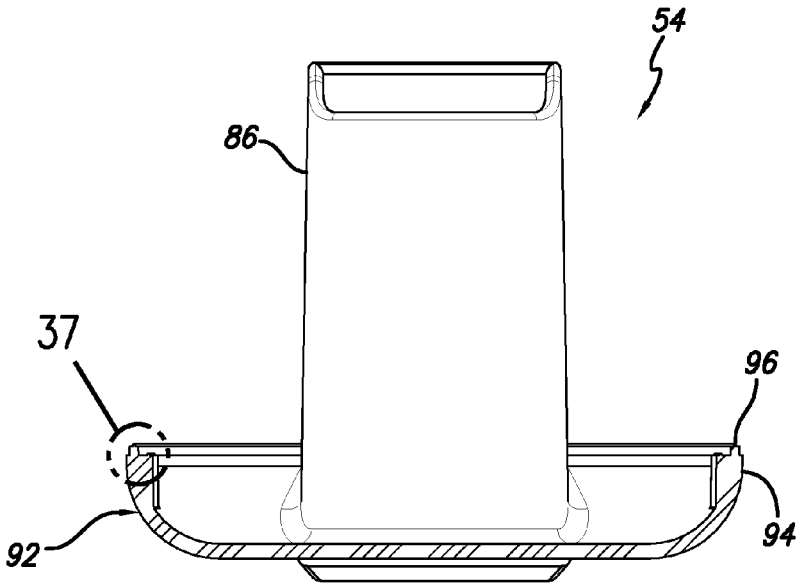
FIG. 36 is a cross-sectional view of the cartridge bottom taken along line 36-36 of FIG. 35.

As best shown in FIGS. 3, 3A, 11, 14, 19, 23 and 25, the interior of top portion 52 is divided by a bowed vertical separator 76 into two compartments, respectively an inlet compartment 78 and an outlet compartment 80 (see FIGS. 19, 21 and 23). Vertical separator 76 is secured or molded to the interior surface of tubular wall 56 and to the underside of top wall 60 in any convenient manner. The bottom end of the vertical separator terminates in an end or terminus 82 (see FIGS. 11, 12 and 16) which is disposed to be connected to a baffle 84. When top and bottom portions 52 and 54 are placed together and a discharge section 86 (FIGS. 10, 11, 14, 29-36, 39, 40 and 42) of bottom portion 54 extends into outlet compartment 80, inlet compartment 78 and outlet compartment 80 have generally equal volumes. It is important that the compartment volumes be made as equal as possible to ensure that the pressures on both sides of vertical separator 76 remain equal during use of the cartridge. Such equally effected pressure helps to minimize syphoning or, alternatively, to maximize resistance to syphoning between the compartments and, of particular importance, of sucking the sealant from the inlet compartment to the outlet compartment. Thus, the usable life of the cartridge is improved by avoiding premature failure thereof. Additionally, any impediment to liquid flow is minimized.

As distinguished from aforementioned application Ser. No. 11/812,242, No. 60/878,635, Ser. No. 11/032,310 and Ser. No. 11/032,508, as shown in FIGS. 1, 3, 8, 9, 11 and 11A, cartridge 50 opens to its exterior essentially through a single entry 64 (and, to a minor extent, via hole 66) that communicates with wastewater inlet compartment 78 through a throat 88 (e.g., see FIGS. 3, 11, 11A, 15, 19, 21, 23, 25, 27, and 28). Single entry 64 is provided with a crescent shape which is intended to reduce the chances of hair from being caught in the entry, as contrasted with multiport entries having bars. Furthermore, as depicted in FIGS. 3-6, 11, 11A, 15, 17, 23, 29, 30 and 33, inlet compartment 78 is closed at its upper side by a ceiling 90. This ceiling over the entry compartment has been lowered, as distinguished from prior cartridges, so that it is slightly lower then the overflow level of the drain stand in the discharge compartment. Thus, there is no air over the sealant except for the small area under the entry opening and the small amount of sealant 57 residing in throat 88. In addition, even if no sealant were present within the throat to act as an odor barrier, there would be only a small area of wastewater 55 within the throat which would be exposed to the air external to the cartridge and, therefore, a lesser opportunity of odor to emanate to the environment outside of the cartridge.

Figure 37:
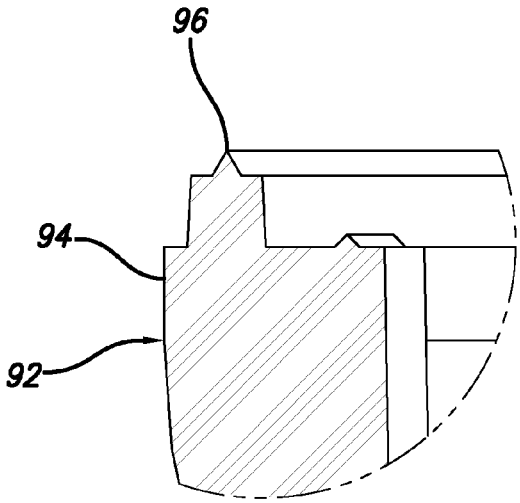
FIG. 37 is a detail of the cartridge bottom taken along cutaway line 37 of FIG. 36.
Figure 38:
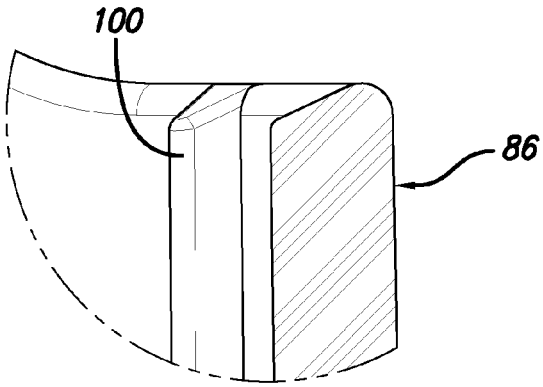
FIG. 38 is a detail of the cartridge bottom taken along cutaway line 38 of FIG. 35.
Figure 39:
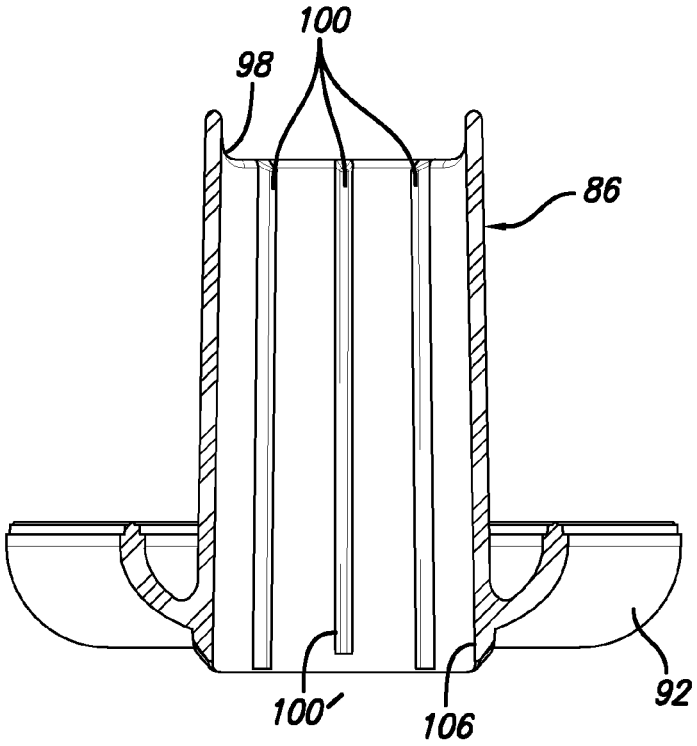
FIG. 39 is a cross-sectional view of the cartridge bottom taken along line 39-39 of FIG. 34.
Figure 40:
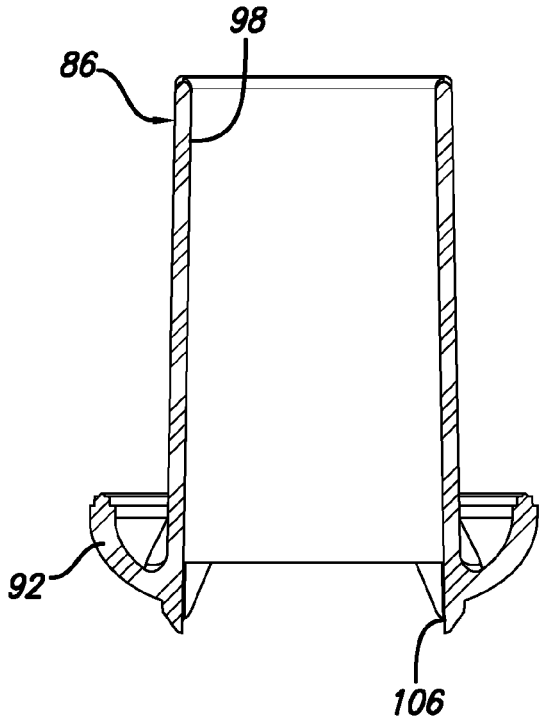
FIG. 40 is a cross-sectional view of the cartridge bottom taken along line 40-40 of FIG. 34.
Figure 41:
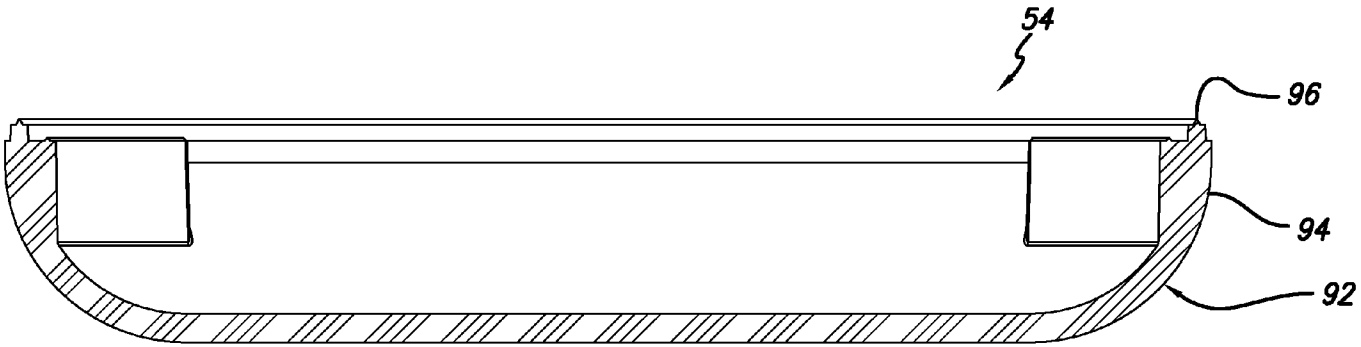
FIG. 41 is a cross-sectional view of the cartridge bottom taken along line 41-41 of FIG. 34.
Figure 42:
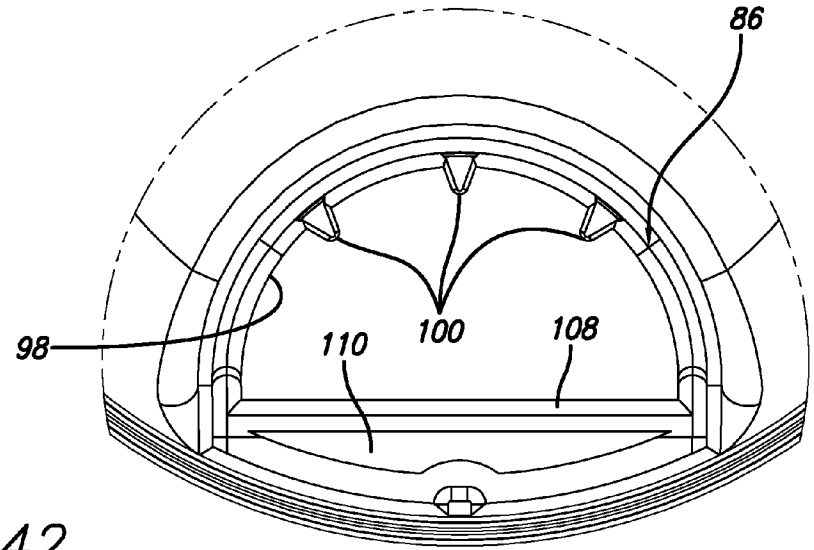
FIG. 42 is a detail of the cartridge bottom taken along cutaway line 42 of FIG. 34.

Bottom portion 54, as depicted in FIGS. 3, 11, and 29-42, comprises a pan 92 and discharge section 86 extending upwardly therefrom. The pan includes a peripheral wall 94 terminating at an edge 96 (e.g., see FIGS. 36 and 37) which provides, as further seen in FIGS. 11, 13 and 16 a tongue-in-groove engagement with tubular wall 56 at its lower end opening 58 to provide a fluid-tight engagement between top and bottom portions 52 and 54. The inner surfaces of pan 92 are rounded to prevent sharp angled corners and are smoothed to enhance fluid flow and to discourage build up of matter and bacteria or other debris.

Upwardly extending discharge section 86, which as described above extends into outlet compartment 80 of top portion 52, includes (see FIGS. 3, 11, 12, 29, 31, 32, 34, 35, 39, 40 and 42) a tube 98 that communicates with outlet compartment 80 and opens at an exit port area 106 (FIGS. 2, 3, 7, 11, 13, 30, 33, 35, 39 and 42) in pan 92 for discharge of fluids, e.g., wastewater fluid and other undesired matter, from the outlet compartment to a drain. Directed fluid flow is implemented, as depicted in FIGS. 2, 7, 10, 11, 14, 29, 31, 32, 34, 35, 38, 39 and 42, by three vertically extending ribs or channel guides 100 which are formed on the walls of tube 98. The channel guides are positioned on the interior of the drain stand, on the side near the center of the trap, with the middle guide 100' (e.g., see FIGS. 2, 33 and 39) being shorter then the other, and not reaching the bottom. Such a trap is typically used with a horizontal drain, which is just below the bottom of the trap. By so guiding the flow of wastewater towards the center, away from the wall of the drain stand near the center of the trap, the wastewater is kept flowing to the center of the drain, which helps to avoid the depositing of sediment on the bottom of the housing, which otherwise would build up and block the cartridge. Furthermore, because the middle guide does not reach the bottom, the two streams tend to move together towards the center of the drain.

As illustrated in FIGS. 10, 11, 13, 14, 29, 31, 34, 35 and 42, a wall 108 is cast within discharge section 86 to separate it into a drain stand (drain tube 98) and a snorkel 110, which extends downwards to just above the level of the horizontal drain (drain tube 98). The snorkel avoids syphoning, by creating a "window" over the water flow to contact the air flow that is present in the drain line from the pipe air trap. Specifically, the snorkel allows air from the drain to pass to the upper portion of the discharge compartment (just below the roof or ceiling 90) so that, even if wastewater covers the opening of the drain stand, air can still enter and prevent syphoning.

A key 102 and a keyway 104 (see FIGS. 11, 13, 14, 19, 21, 26, 29-31, 33-35 and 42) are provided respectively on the interior surface of tubular wall 56 and on the backside of upwardly extending discharge section 86. The key and keyway are disposed to provide an orientation and proper alignment between top and bottom portions 52 and 54 and, through the orienting mechanism of keys 68 with the urinal, to place exit port area 106 adjacent the exterior drain.

Although the invention has been described with respect to particular embodiments thereof, it should be realized that various changes and modifications may be made therein without departing from the spirit and scope of the invention.

What is claimed is:

1. In a wastewater cartridge, couplable to an external drain, having an upper wall (60), an opening (64) therein for receipt of wastewater, an inlet compartment (78) which is generally located under the opening for receipt of the wastewater from the opening and which has an outer periphery as defined by a peripheral wall, and a sealant which is contained in the inlet compartment, which is floatable on the wastewater therein and which is disposed to act as a barrier to external drain and other odors, and an outlet compartment communicating with the inlet compartment and the external drain, the improvement comprising:

a ceiling (90) having a surface of given area bounding the inlet compartment (78), which said ceiling is spaced from the upper wall (60) and from the wastewater-receiving opening (64);

a separator (76) extending from the upper wall separating the inlet compartment from the outlet compartment; and a throat (88) communicating the inlet compartment with the wastewater-receiving opening, said throat having an area which is less than the area of said ceiling and which has a lower end, whereby the amount of the sealant acting as the barrier, as contained by said throat, is less than any further amount of the sealant under said ceiling which floats on the wastewater in said inlet compartment, and whereby said ceiling surface extends outwardly and downwardly from said lower end of said throat to the outer periphery of said inlet compartment as defined by said peripheral wall and said separator (FIGS. 11 & 11A) for enabling the sealant to flow to said throat.

2. The improvement according to claim 1 in which the sealant extends laterally beyond the throat so that the majority of the surface of the sealant is not exposed to air.

3. The improvement according to claim 1 further including a discharge section (86) coupled between said outlet compartment and the external drain, a wall disposed in said discharge section and separating said discharge section into a drain tube (98) and a snorkel (110) which extends downwards generally to above the level of the external drain, whereby said snorkel allows any air from the external drain to pass to said outlet compartment generally below said ceiling (90) so that, should wastewater cover the opening of said drain tube, such air is permitted to enter and prevent syphoning.

4. The improvement according to claim 1 further including:

a discharge section (86) which is coupled between said outlet compartment and the external drain and which includes a drain tube (98) having walls surrounding a center and communicating with said outlet compartment (80) and opens at an exit port area (106) for discharge of the wastewater fluid from said outlet compartment to the drain; and a channel guide mechanism (100) formed within said tube guiding flow of the wastewater towards said drain tube center, and away from said drain tube walls, whereby the wastewater is kept flowing towards said drain tube center to avoid deposit of any sediment contained in the wastewater.

5. The improvement according to claim 4 wherein said channel guide mechanism includes three vertically extending ribs, with the middle one of said ribs being shorter then said outer ribs so as to guide the wastewater flow towards said drain tube center and away from its walls.

6. A wastewater cartridge having a wastewater-receiving opening, comprising:

an inlet compartment for receipt of wastewater extending to an outer periphery, which is defined by a peripheral wall, and having an upper side ceiling (90) terminated by a surface;

a separator (76) extending from the upper wall for separating the inlet compartment from an outlet compartment;

a throat (88) communicating the inlet compartment with the wastewater-receiving opening, said throat having an area which is less than the area of said ceiling and which has a lower end, the outlet compartment having a terminus for transfer of the wastewater from said inlet compartment to an external drain; and a discharge section (86) coupled between said outlet compartment and the external drain, a wall disposed in said discharge section and separating said discharge section into a drain tube (98) and a snorkel (110) which extends downwards generally to above the level of the horizontal drain, whereby said snorkel allows any air from the external drain to pass to said outlet compartment generally below said ceiling (90) so that, should wastewater covers the opening of said drain tube, such air is permitted to enter and prevent syphoning, and whereby said ceiling surface extends outwardly and downwardly from said lower end of said throat to the outer periphery of said inlet compartment as defined by said peripheral wall and said separator (FIG. 11A) for enabling the sealant to flow to said throat.

7. The cartridge according to claim 6 wherein said drain tube (98) has walls surrounding a center, communicates with said outlet compartment (80) and opens at an exit port area (106) for discharge of the wastewater fluid from said outlet compartment to the drain and further including:

a channel guide mechanism (100) formed within said tube guiding flow of the wastewater towards said drain tube center, and away from said drain tube walls, whereby the wastewater is kept flowing towards said drain tube center to avoid deposit of any sediment contained in the wastewater.

8. The cartridge according to claim 7 wherein said channel guide mechanism includes three vertically extending ribs, with the middle one of said ribs being shorter then said outer ribs so as to guide the wastewater flow towards said drain tube center and away from its walls.

9. The improvement according to claim 1 wherein, in the absence of said sealant to act as an odor barrier, the area of said throat, as containing a like area of the wastewater, would permit exposure only that wastewater area to the air external to the cartridge and, therefore, would provide a lesser opportunity of odor to emanate to the outside cartridge environment.

10. A method for conserving a liquid quantity of a liquid odor sealant in a wastewater cartridge having an upper wall (60), an opening (64) therein for receipt of wastewater, an inlet compartment (78) which has an outer periphery as defined by a peripheral wall and which is generally positioned under the opening for receipt of the wastewater from the opening, a sealant which is contained in the inlet compartment, which is floatable on the wastewater therein and which is disposed to act as a barrier to external drain and other odors, and an outlet compartment coupled to the inlet compartment, said method comprising the steps of:

spacing a ceiling (90) of given area of the inlet compartment (78) and having a surface, from the upper wall (60) and from the wastewater-receiving opening (64);

communicating the inlet compartment with the wastewater-receiving opening by a throat (88) having an area which is less than that of the ceiling and having a lower end;

separating the inlet and outlet compartments by a separator; and extending the ceiling surface outwardly and downwardly from the lower end of the throat to an outer periphery of the inlet compartment as defined by the peripheral wall and the separator (FIGS. 11 & 11A) for enabling the sealant to flow to the throat, so that the amount of the sealant acting as the barrier, as contained by the throat, is less than any further amount of the sealant under the ceiling which floats on the wastewater in the inlet compartment.

11. The method according to claim 10 further comprising the step of extending the sealant layer flush against the ceiling and into the throat.

12. The method according to claim 10, in the absence of the sealant to act as an odor barrier, further comprising the step of limiting the area of wastewater to that of the throat, so as to permit exposure only of that wastewater area to the exterior of the cartridge and, accordingly, to provide a lesser opportunity of odor to escape from the cartridge.

13. A wastewater cartridge having a top portion with a generally cylindrical configuration and comprising:

a tubular wall (56);

an upper wall (60) having an upper surface sloping downwardly from an outer periphery of the tubular wall towards an entrance opening (64) for receipt of wastewater (55);

an inlet compartment (78) disposed generally below the opening for temporary storage of at least some of the received wastewater;

an outlet compartment (80) in communication with the inlet compartment for transfer of at least some of the received wastewater to an external drain (not shown), a vertical separator (76) extending downwardly from the upper wall for separating the inlet compartment from the outlet compartment;

a ceiling (90) defining a downwardly facing ceiling surface between the upper wall and the inlet compartment;

a throat (88) extending through the ceiling from the entrance opening to the inlet compartment, the throat having an area which is less than the area of the ceiling; and a drain tube (98) within the outlet compartment with a lower end (106) directed towards the external drain and an upper end defining a predetermined outlet level;

wherein the inlet compartment and the throat are adapted to contain a fluid sealant (57) floating on any wastewater contained therein to thereby act as a barrier to odors from the received wastewater and the external drain, characterized in that:

the ceiling surface extends outwardly and downwardly from a lower end of the throat to an outer periphery of the inlet compartment defined by the tubular wall and the vertical separator (FIG. 11A).

14. The wastewater cartridge of claim 13, further characterized in that the ceiling surface is entirely below the predetermined outlet level (FIG. 11).

15. The wastewater cartridge of claim 13, further characterized in that the ceiling surface slopes upwardly from the outer periphery of the inlet compartment towards a lower surface of the throat (FIGS. 11, 11A) whereby the sealant and any air entrapped therein is free to flow into the throat (FIGS. 3, 11).

16. The wastewater cartridge of claim 13, further characterized in that the majority of an upper surface of the sealant is not exposed to air (FIG. 3).

17. The wastewater cartridge of claim 13, further characterized in that the amount of the sealant acting as the barrier, as contained by the throat, is less than any further amount of the sealant under the ceiling which floats on the wastewater in the inlet compartment (FIGS. 3, 11).

18. The wastewater cartridge of claim 13, further characterized in that, in the absence of the sealant to act as an odor barrier, the area of the throat would contain a like area of the wastewater and would permit exposure of only that wastewater area to the air external to the cartridge, thereby providing a lesser opportunity of odor to emanate to the outside cartridge environment.

19. The wastewater cartridge of claim 13, further characterized in that the output compartment further comprises a snorkel (110) which extends downwardly from an air chamber above the drain tube entrance to a second air chamber just above the drain tube exit (FIGS. 11,13), whereby the snorkel allows air from the external drain to flow into the upper end of the drain tube and thereby prevent any siphoning of wastewater through the drain tube from the inlet compartment to the external drain.

20. The wastewater cartridge of claim 13, further characterized in that the drain tube further comprises a channel guide mechanism (FIGS. 34, 35, 39) formed within the tube for guiding flow of the wastewater towards the drain tube center, and away from the drain tube walls, whereby the wastewater is kept flowing towards the drain tube center to avoid deposit of any sediment contained in the wastewater.

21. The wastewater cartridge of claim 20, further characterized in that the channel guide mechanism includes three vertically extending ribs (100), with the middle one (100') of the ribs being shorter then the outer ribs so as to guide the wastewater flow towards the drain tube center and away from its walls.

* * * * *